US005918915A

United States Patent [19]

Calteux

[11] Patent Number: 5,918,915

[45] Date of Patent: Jul. 6, 1999

[54] SLIDING DOOR LOCK

[76] Inventor: Kenneth J. Calteux, 556 W. Mendoza, Mesa, Ariz. 85210

[21] Appl. No.: 08/963,326

[22] Filed: Nov. 3, 1997

[51] Int. Cl.[6] ..... E05C 19/00

[52] U.S. Cl. ..... 292/1; 292/DIG. 46; 292/253

[58] Field of Search ..... 292/1, 253, DIG. 46, 292/DIG. 24, 288, 340, 258, 289, 298, DIG. 16; 24/205.2; 428/100

[56] References Cited

U.S. PATENT DOCUMENTS

| | | | |
|---|---|---|---|
| 2,918,318 | 12/1959 | Sacharski | 292/87 |
| 3,997,205 | 12/1976 | MacDonald | 292/288 |
| 4,059,299 | 11/1977 | Huntley | 292/294 |
| 4,163,303 | 8/1979 | Hanna | 16/135 |
| 4,712,816 | 12/1987 | Mueller | 292/253 |
| 5,125,699 | 6/1992 | Dinan | 292/288 |
| 5,517,838 | 5/1996 | Moore | 70/14 |
| 5,623,841 | 4/1997 | Deemar | 70/14 |

*Primary Examiner*—Steven Meyers
*Assistant Examiner*—Stephen Grady
*Attorney, Agent, or Firm*—Richard G. Harrer; Charles E. Cates

[57] ABSTRACT

A locking device for a set of double sliding doors comprising two U-shaped clips and a flexible band operatively engaging both clips. The locking device is designed to prevent the relative movement of double sliding doors which comprise an interior door and an exterior door, with the interior door sliding in an interior track and the exterior door sliding in an exterior track. The interior and exterior tracks are parallel to each other. In a closed position, an inside vertical stile of the interior door is adjacent to, and which overlaps an inside vertical stile of the exterior door defining a space between the interior and exterior doors. A U-shaped clip is secured to the inside stile of each sliding door. The flexible band is secured at its first end to the U-shaped clip secured to the inside stile of the interior door and then traverses through the space between the interior and exterior doors to the inside stile of the exterior door. At its second end, the flexible band is removably secured to the U-shaped clip secured to the inside stile of the exterior door. When the double sliding doors are in a closed position, they can be locked in a fixed position by securing the second end of the flexible band to the U-shaped clip secured to the inside stile of the exterior door. The double sliding doors are then unlocked by disengaging the second end of the flexible band from the U-shaped clip secured to the inside stile of the exterior door.

4 Claims, 1 Drawing Sheet

SLIDING DOOR LOCK

FIELD OF THE INVENTION

This invention relates to locking devices for double sliding doors.

BACKGROUND OF THE INVENTION

This invention is a child safety device for "child-proofing" residential interior closets. Specifically, the invention is directed towards a removable lock for a pair of double sliding doors. The Consumer Product Safety Commission (CPSC) reports that nearly 50,000 children are injured each year from accidentally coming into contact with electrical appliances, cords, and other equipment. The CPSC further reports that close to one million children injure themselves from ingesting medicines or chemicals found in the home. Of those 1 million cases, about 50 ended in death. The number of injuries caused by house-hold hazards can be reduced through the use of devices that prevent children from gaining access to the equipment or medicines that may harm them. This invention, a removable lock for double sliding closet doors, is one such "child-proofing" device.

BRIEF SUMMARY OF THE INVENTION

The primary objective of the invention is to "child-proof" residential interior closets using a locking device which will lock double sliding doors in a closed position preventing children from gaining access to the closet. The locking device includes two U-shaped clips, an interior clip and an exterior clip, and a flexible band operatively engaging both U-shaped clips. This locking device is designed to operate on double sliding doors, an interior door and an exterior door, wherein the interior door slides in an interior track and the exterior door slides in an exterior track. The interior and exterior tracks are parallel to each other. Thus, in a closed position a vertical stile of the interior door is adjacent to a vertical stile of the exterior door, defining a space, between the interior and the exterior doors, where the doors overlap.

It is a further objective of the invention to ensure that the locking device can be easily secured to closet doors without having to modify or damage the doors. The interior U-shaped clip slides onto the stile of the interior door and the exterior U-shaped clip slides onto the stile of the exterior door. Both clips are secured to the stiles of the doors through a frictional fit between the U-shaped clip and the stile. Both of these clips remain secured to the stiles of the closet doors while the doors are opened or closed. The inner sides of the U-shaped clips can be provided with padding to prevent the clips from damaging the surfaces of the closet door stiles.

Another objective of the invention is to ensure that the lock can be disarmed and reset easily to provide parents with easy access to the closet. The flexible band is secured at its first end to the interior U-shaped clip. When the locking device is not engaged to lock the closet, the flexible band is secured only to the interior U-shaped clip. The flexible band is provided with means on its second end to be removably attached to the exterior U-shaped clip. When the closet doors are shut and the stiles of the interior and exterior doors are in approximate alignment, there is a space, where the inside stiles of both doors overlap, between the interior and exterior doors. In a closed position, the flexible band passes from its first end secured to the interior U-shaped clip through the space between the two doors to the stile of the exterior door where it can be secured at its second end to the exterior U-shaped clip. When the second end of the flexible band is secured to the exterior U-shaped clip, the closet doors are locked in a fixed position. The closet doors can then be unlocked by removing the second end of the flexible band from the exterior U-shaped clip. One end of the exterior U-shaped clip can be shaped to form a handle to ensure that the flexible band can be easily attached and unattached.

DETAILED DESCRIPTION OF A PREFERRED EMBODIMENT

Figure 1:
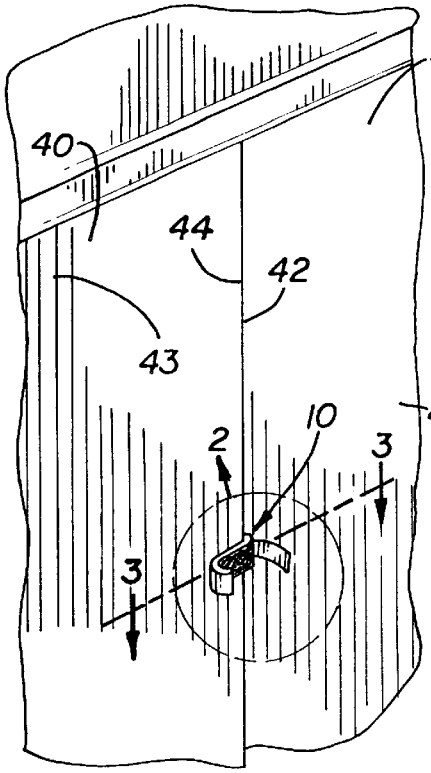
FIG. 1 is a partial perspective view of the locking device of the invention in an unlocked mode on a pair of double sliding doors.

FIGS. 1 through 7 show a presently preferred embodiment of the invention. In FIG. 1, the locking device 10 is shown in the unlocked mode mounted on a pair of double sliding doors 40. The double sliding doors 40 include an exterior door 43 having an exterior door stile 44 and an interior door 41 having an interior door stile 42. Interior door 41 and exterior door 43 are in a closed position. Interior door stile 42 is adjacent to exterior door stile 44 defining a space 70, where the inside stiles of both doors overlap, when the doors are in a closed position, best visible in FIG. 3. Exterior U-shaped clip 30 is secured frictionally to the exterior door stile 44. Flexible 15 band 60 is shown unattached to the exterior U-shaped clip 30. While the flexible band 60 is unattached to the exterior U-shaped clip 30, the lock is unlocked and the doors may be opened.

Figure 2:
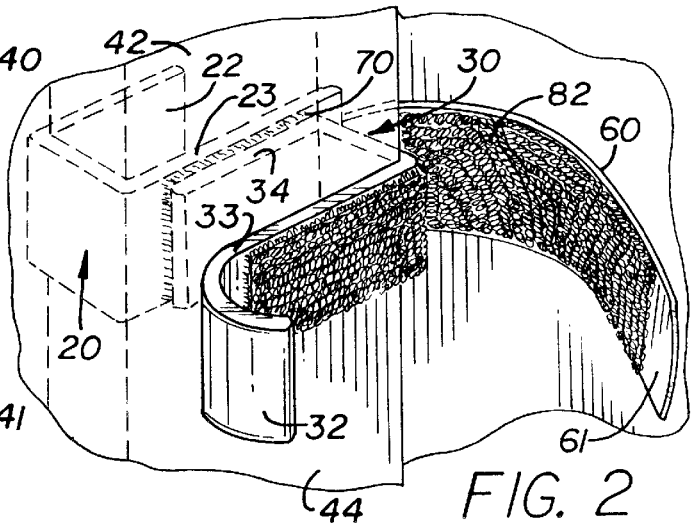
FIG. 2 is an enlarged view of the area 2 shown in FIG. 1.
Figure 3:
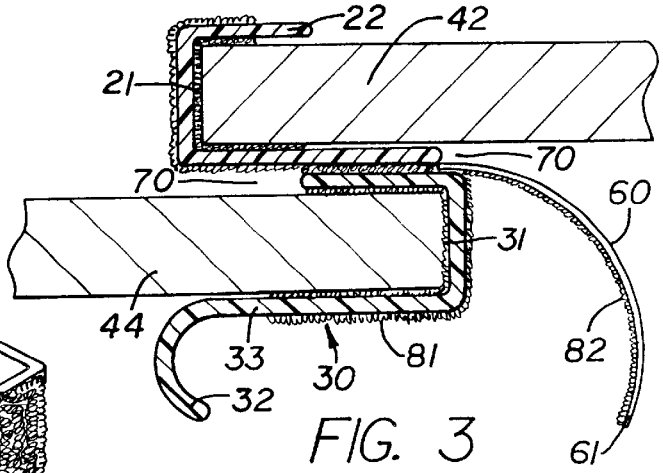
FIG. 3 is a sectional view taken on the line 3—3 of FIG. 1.

FIG. 2 is an enlarged view of area 2 shown in FIG. 1. Interior door 41, visible in FIG. 1, and exterior door 43, visible in FIG. 1, are in a closed position. Interior door stile 42 is adjacent to exterior door stile 44 defining a space 70, where the inside stiles of both doors overlap, when the doors are in a closed position. Exterior U-shaped clip 30 is secured frictionally to the exterior door stile 44. Interior U-shaped clip 20 is frictionally secured to the interior door stile 42 of the interior door 41, visible in FIG. 1. Interior U-shaped clip 20 has an exterior side 22 and an interior side 23. Exterior 25 U-shaped clip 30 has an exterior side 33 and an interior side 34. Interior side 23 of interior U-shaped clip 20 is adjacent to interior side 34 of exterior U-shaped clip 30 within space 70 when the double sliding doors 40 are in a closed position. (This may not always be the case as stated in the previous sentence or as depicted in FIGS. 2 and 3.) Flexible band 60 is shown unattached to the exterior U-shaped clip 30. Flexible band 60 is secured to the interior U-shaped clip 20. While the flexible band 60 is unattached to the exterior U-shaped clip 30, the lock is unlocked. In one preferred embodiment, the means for securing the second end of the flexible band 60 to the exterior U-shaped clip 30 is comprised of a hook and loop fastener. In FIG. 2, the loops 81 of the hook and loop fastener are shown secured to the exterior side 33 of the exterior U-shaped clip 30. The hooks 82 of the hook and loop fastener are shown secured to the inner side 61 of the flexible band 60. When the hooks 82, secured to the flexible band 60, engage the loops 81 secured to the exterior side 33 of the exterior U-shaped clip 30, the locking device is locked. To disengage the hooks 82 from the loops 81, an operator holds the handle 32 formed out of the end of the exterior side 33 of the exterior U-shaped clip 30 and pull the flexible band 60 away from the exterior U-shaped clip 30. Note that the hooks 82 could be secured to the exterior side 33 of the exterior U-shaped clip 30 and loops 81 could be secured to the inner side 61 of the flexible band 60 in an alternative embodiment.

FIG. 3 is a sectional view taken on the line 3—3 of FIG. 1. Locking device 10 visible in FIG. 1 is in the unlocked mode. Space 70 is defined by the interior stile 42 and the exterior stile 44 when the double sliding doors 40 are in a closed position. Interior U-shaped clip 20 is secured to the interior stile 42. Interior U-shaped clip 20 has interior side 23 and exterior side 22. Mounted on the inner portion of the interior U-shaped clip 20 is padding 21. Exterior U-shaped clip 30 having interior side 34 and exterior side 33 is secured to the exterior stile 44. Mounted on the inner portion of the exterior U-shaped clip 30 is padding 31. Flexible band 60 secured to the outer portion of the interior U-shaped clip 20 is shown disengaged from the outer portion of the exterior U-shaped clip 30.

Figure 4:
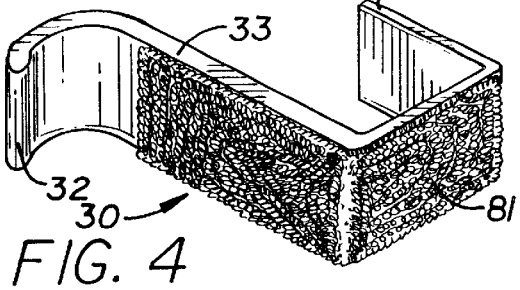
FIG. 4 is a perspective view of an exterior U-shaped clip.

FIG. 4 is a perspective view of an exterior U-shaped clip 30 having an exterior side 33 and an interior side 34. The exterior U-shaped clip 30 can be made out of plastic in a preferred embodiment. A handle 32 is formed out of an end of the exterior side 33. Loops 81 of the hook and loop fastener visible in FIG. 2 is secured to the outer portion of the exterior U-shaped clip 30.

Figure 5:
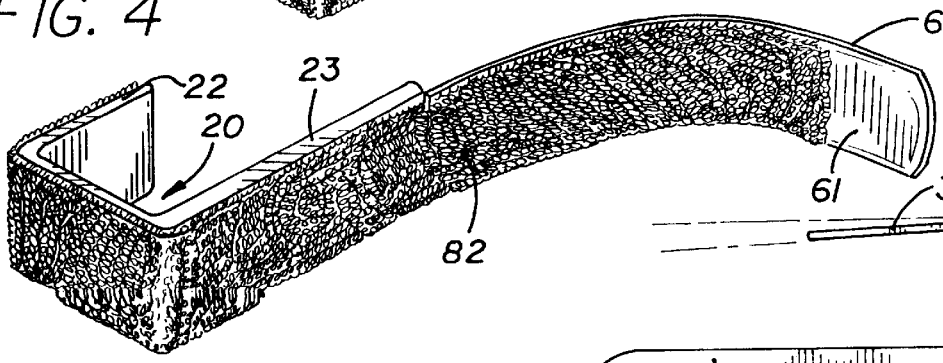
FIG. 5 is a perspective view showing a flexible band secured to an interior U-shaped clip.

FIG. 5 is a perspective view of the flexible band 60 secured to the outer portion of the interior U-shaped clip 20. The hooks 82 of the hook and loop fastener visible in FIG. 2 is secured to the inner side 61 of flexible band 60. In a preferred embodiment, the interior U-shaped clip 20 having an interior side 23 and an exterior side 22 is made out of plastic. The flexible band 60 should be of a durable, yet, flexible material such as nylon, polyester, plastic or cloth.

Figure 6:
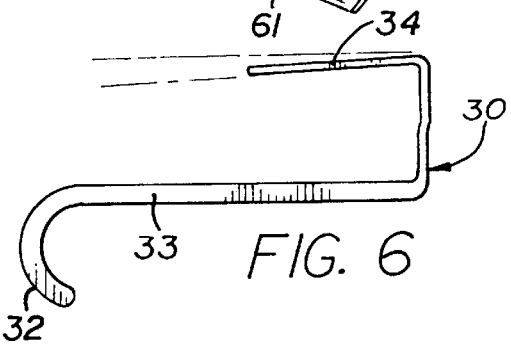
FIG. 6 is a top view of an exterior U-shaped clip.

FIG. 6 is a top view of the exterior U-shaped clip 30. The handle 32 is formed out of one end of the exterior side 33 of the exterior U-shaped clip 30. The interior side 34 of the exterior U-shaped clip 30 is bent inward toward the inner surface of the exterior side 33 to create the frictional fit between the exterior U-shaped clip 30 and the exterior door stile 44.

Figure 7:
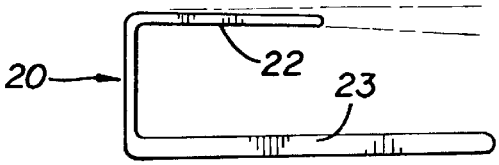
FIG. 7 is top view of an interior U-shaped clip.

FIG. 7 is a top view of the interior U-shaped clip 20. The exterior side 22 of the interior U-shaped clip 20 is bent inward toward the inner surface of the interior side 23 to create the frictional fit between the interior U-shaped clip 20 and the interior door stile 42.

Padding is not shown in FIGS. 6 and 7. Other padding options would be available to accommodate different door stile designs.

I claim:

1. A device for locking a set of double sliding doors having an interior door and an exterior door, with the interior door sliding in an interior track and an exterior door sliding in an exterior track, with said interior and exterior tracks being parallel to each other and whereby in a closed position a vertical stile of the interior door is adjacent to and overlaps a vertical stile of the exterior door, and in such position said stiles defining a space between said interior and exterior doors, said device comprising:

a. a first generally U-shaped clip for attachment to the vertical stile of said interior sliding door;

b. a second generally U-shaped clip for attachment to the vertical stile of said exterior sliding door;

c. a flexible band having first and second ends with a first end secured to the exterior portion of said first U-shaped clip, said flexible band being of a length such that it can extend from said first U-shaped clip through the space between said interior and exterior doors when in a closed position to said second U-shaped clip; and d. means provided on said second U-shaped clip for removably attaching said second end of said band to said second U-shaped clip.

2. A device as recited in claim 1 wherein said U-shaped clips are capable of being attached to said vertical stiles by means of a compression fit.

3. A device as recited in claim 2 wherein said second U-shaped clip is provided with a handle.

4. A device as recited in claim 3 wherein said second end of said flexible band is provided with means for removable attachment to said second U-shaped clip.

* * * * *